United States Patent [19]

Nagaishi

[11] Patent Number: 4,852,538

[45] Date of Patent: Aug. 1, 1989

[54] FUEL INJECTION CONTROL SYSTEM FOR INTERNAL COMBUSTION ENGINE

[75] Inventor: Hatsuo Nagaishi, Zushi City, Japan

[73] Assignee: Nissan Motor Co., Ltd., Yokohama, Japan

[21] Appl. No.: 239,830

[22] Filed: Nov. 3, 1988

Related U.S. Application Data

[63] Continuation of Ser. No. 923,983, Oct. 28, 1986, abandoned.

[30] Foreign Application Priority Data

Oct. 29, 1985 [JP] Japan ..... 60-243605
Jan. 9, 1986 [JP] Japan ..... 61-2810

[51] Int. Cl.[4] ..... F02D 41/30

[52] U.S. Cl. ..... 123/492; 123/493; 123/480

[58] Field of Search ..... 123/492, 493, 480, 486

[56] References Cited

U.S. PATENT DOCUMENTS 4,357,923 11/1982 Hideg ..... 123/492
4,388,906 6/1983 Sugiyama et al. ..... 123/492
4,454,847 6/1984 Isomura et al. ..... 123/492

FOREIGN PATENT DOCUMENTS 59-203829 11/1984 Japan ..... 123/493

*Primary Examiner*—Andrew M. Dolinar
*Attorney, Agent, or Firm*—Pennie & Edmonds

[57] ABSTRACT

A fuel injection control system for controlling the amount of fuel to be injected to an internal combustion engine. The fuel injection control system consists of a control unit arranged to calculate the fuel injection amount in accordance with a standard injection amount corrected with a transient correction amount. The transient correction amount is calculated in accordance with a difference value and a correction coefficient which is previously set in accordance with engine operating condition. The difference value is of between an equilibrium amount of adhering and floating fuel in steady state in an intake system and a predicted variable of amount of the adhering and floating fuel at a predetermined point of time.

15 Claims, 16 Drawing Sheets

DURING ACCELERATION

DURING DECELERATION

DURING GEAR-CHANGING
THROTTLE POSITION (OPENING DEGREE) Cv
Mϕ
M
Mϕ − M
DKN
DKTw
DK
DM
TpF
Tp
Tp, TpF
0

START
P61
FEEDBACK CONDITION ?
YES
NO
P62
Vs > S/L
YES
NO
P63
FIND α FROM STEADY STATE LEARNING RESULT
P65
CALCULATE CORREC. AMOUNT (P, I) (P, I --- POSITIVE)
P66
CALCULATE CORREC. AMOUNT (P, I) (P, I --- NEGATIVE)
P67
α = PREV. α + P + I
P68
|DM| < LGDM
NO
YES
P71
n < LGn
YES
NO
P69
CALCULATE Σα COUNT n
P72
α = Σα / n
P73
REWRITE RAM (CORRESPONDING TO Tw) WITH α̅
P74
Σα = 0
n = 0
P64
Σα = 0
n = 0
P70
PERFORM STEADY STATE LEARNING AND CALCULATION
END

FUEL INJECTION CONTROL SYSTEM FOR INTERNAL COMBUSTION ENGINE

CROSS REFERENCE TO RELATED APPLICATION

This is a continuation of a application Ser. No. 06/923,983, filed Oct. 28, 1986, now abandoned.

BACKGROUND OF THE INVENTION

1. Field of the Invention

The present invention relates generally to an improvement in a fuel injection control system for an internal combustion engine to control fuel injection amount in accordance with engine operating conditions, and more particularly to such a fuel injection control system arranged to decide an appropriate fuel injection amount during transient time or transient engine operation (such as acceleration and deceleration) of engine operation by correcting a standard fuel injection amount in accordance with engine operating conditions.

2. Description of the Prior Art

In connection with fuel injection control by using a fuel injection control system for an automotive internal combustion engine, shift of air-fuel ratio of air-fuel mixture from a target level generally largely depends upon change in amount of fuel adhering on the inner wall surface of an intake manifold and an intake port of an intake system of the engine and fuel floating in the same places. The amount of the adhering and floating fuel changes largely depending upon engine operating conditions. Furthermore, the amount of such adhering and floating fuel does change stepwise but changes with delay whose time constant is variable. Moreover, change in the amount of the adhering and floating fuel greatly depends not only upon engine operating conditions but also upon the difference between the amount of adhering and floating fuel at that point of time and that in an equilibrium state (steady state). Thus, the amount of the adhering and floating fuel in the intake system changes in a very complicated mechanism during engine operations and therefore it is difficult to control fuel injection amount precisely in accordance with engine operating conditions, particularly during transient time of engine operation.

In order to attain precise fuel injection control, a proposal has been made as disclosed in European Patent Publication No. 0152019 (Application Ser. No. 85100998.5). This proposal is directed to a method for controlling fuel injection for an engine in which, on the basis of a phenomenon that a part of fuel vapored from a liquid film ahdered on a wall surface of an intake manifold remains in an intake manifold in the form of fuel vapor, the quantity of the liquid film and the quantity of the fuel vapor are estimated by using control parameters such as air mass flowing through a throttle valve, a throttle opening degree, an engine speed, an air-fuel ratio, etc. The quantity of the liquid film and the quantity of the fuel vapor at a desired point of time are predicted on the basis of the result of estimation. Additionally, the quantity of fuel injection is controlled so as to make the air-fuel ratio be a desired level. Further, the quantity of the liquid film is estimated in the case where the data as to the air-fuel ratio obtained by an $O_2$ sensor includes an observation delay. A sum of the quantity of fuel vapored from the liquid film at a desired point of time and the quantity of fuel which does not adhere on a wall surface of the intake manifold is predicted on the basis of the result of the estimation. Additionally, the quantity of fuel injection is controlled so as to make the observed air-fuel ratio be a desired lever on the assumption that the quantity of fuel corresponding to the estimated sum is sucked into an engine cylinder.

However, in such a conventional fuel injection control method, transient time of engine operation have been intensively taken into consideration and therefore correction coefficient for the transient time has not decided. Accordingly, with this conventional fuel injection control method, it is impossible to achieve a precise fuel injection control in accordance with engine operating conditions, particularly during transient time of engine operation.

SUMMARY OF THE INVENTION

A fuel injection control system according to the present invention consists of first to eighth means a to h as shown in FIG. 1. First means a is provided to detect operating condition of an internal combustion engine. Second means b is provided to calculate a standard injection amount in accordance with the engine operating condition. Third means c is provided to calculate an equilibrium amount of adhering and floating fuel in an intake system of the engine, in a steady state of engine operation, in accordance with the engine operating condition. Fourth means d is provided to calculate a difference value between the equilibrium amount of the adhering and floating fuel in the intake system, calculated by the third means, and a predicted variable of an amount of the adhering and floating fuel in the intake system at a predetermined point of time. Fifth means e is provided to calculate a transient correction amount in accordance with the difference value calculated by the fourth means and a correction coefficient which is previously set in accordance with operating condition of the engine. Sixth means f is provided to newly calculate the predicted variable of the adhering and floating fuel in accordance with the transient correction amount calculated by the fifth means and the precited variable of the adhering and floating fuel. Seventh means g is provided to calculate a fuel injection amount in accordance with the standard injection amount calculated by the second means and the transient correction amount calculated by the fifth means, and to output an injection signal representative of the fuel injection amount. Additionally, eighth means h is provided to supply fuel to the engine in accordance with the injection signal from the seventh means.

Accordingly, particularly by virtue of the fifth means for calculating the transient correction amount, the transient correction amount precisely correlative with engine operation can be obtained during transient time of engine operation, so that fuel injection amount during the transition time is precisely corrected in accordance with the transition correction amount. This greatly improves precision of control of air-fuel ratio of air-fuel mixture to be supplied to the engine, thereby achieving driveability improvement, harmful gas emission reduction, power output increase, and fuel economy improvement.

DETAILED DESCRIPTION OF THE INVENTION

Figure 2:
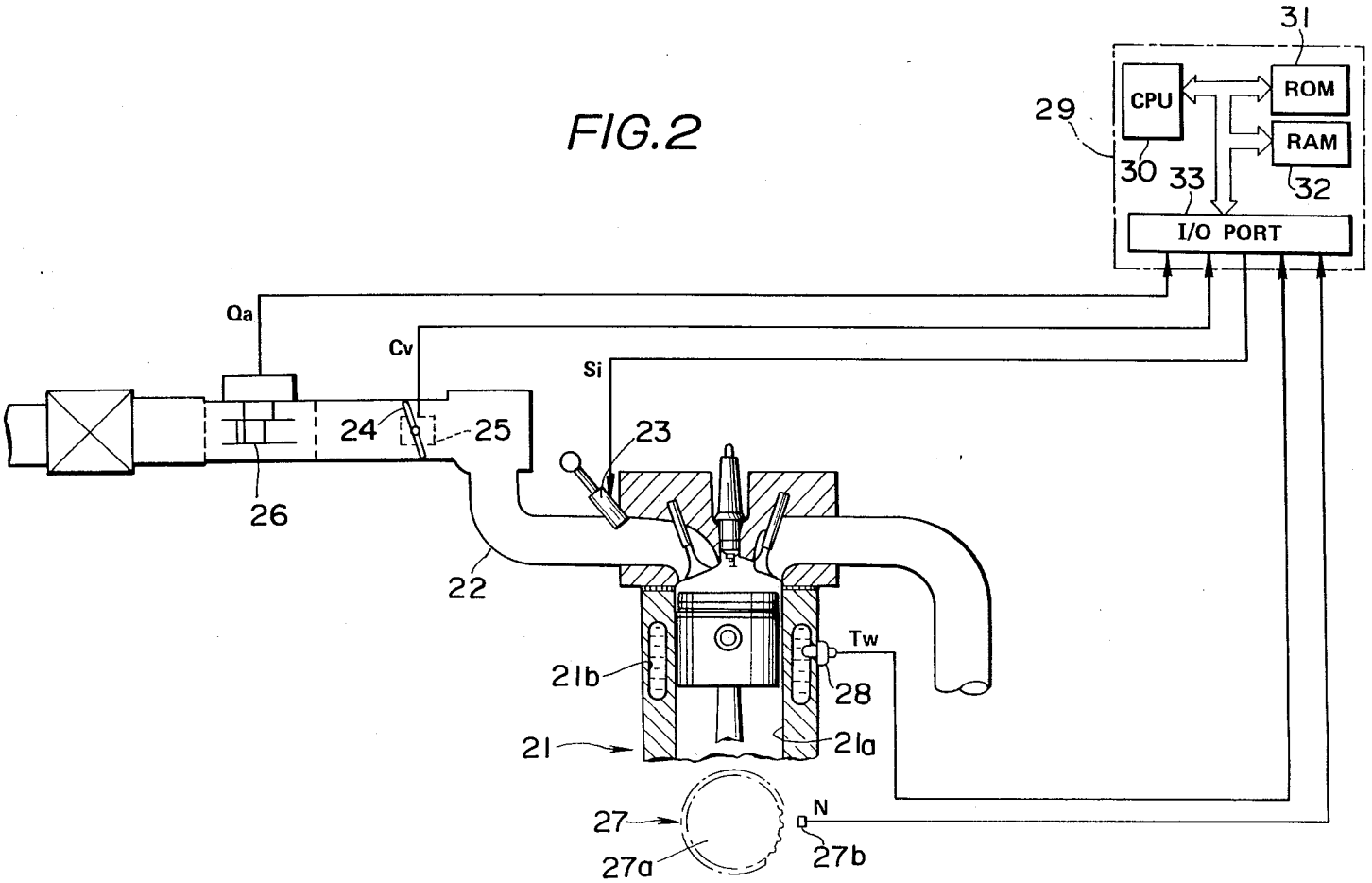
FIG. 2 is a schematic illustration, partly in section, of the first embodiment fuel injection system incorporated with an internal combustion engine.

Referring now to FIGS. 2 to 10C of the drawings, a first embodiment of a fuel injection control system of an internal combustion engine 21 is illustrated. In this embodiment, the engine 21 is of an automotive vehicle. In FIG. 2, the engine 21 has a plurality of engine cylinders 21*a* each of which is to be supplied with intake air through an each intake pipe 22 or a branch runner of an intake manifold. A fuel injector valve 23 as fuel supply means is installed to each intake pipe 22 to inject fuel to be supplied together with the intake air into each engine cylinder 21*a*. A throttle valve 24 is rotatably disposed inside a gathering section of the intake pipes 22 to control the flow rate of the intake air to be supplied to the engine 21. The throttle valve 24 is mechanically connected to and in timed relatioln to an accelerator pedal (not shown) of the vehicle to be operated in timed relation to the same pedal. A throttle position sensor 25 is provided to detect the opening degree or throttle position Cv of the throttle valve 24. An air flow sensor 26 is provided to detect the flow rate (referred hereinafter to as "intake air amount") Qa of the intake air. Additionally, a crank angle sensor 27 is provided to detect engine speed N of the engine 21, and consists of a signal disc plate 27*a* which is fixedly mounted on a crankshaft (not shonw) of the engine 21 and provided at its outer periphery with a plurality of projections. A magnetic head 27*b* is disposed near the outer periphery of the signal disc plate 27*a* to sense the projection. A coolant temperature sensor 28 is provided to detect temperature Tw of engine coolant or cooling water flowing through a water jacket 21*b*. The above-described throttle position sensor 25, the air flow sensor 26, the crank angle sensor 27 and the coolant temperature sensor 28 constitute as a whole "operating condition detecting means" and are so arranged that signal output from each sensor is input to a control unit 29.

Figure 1:
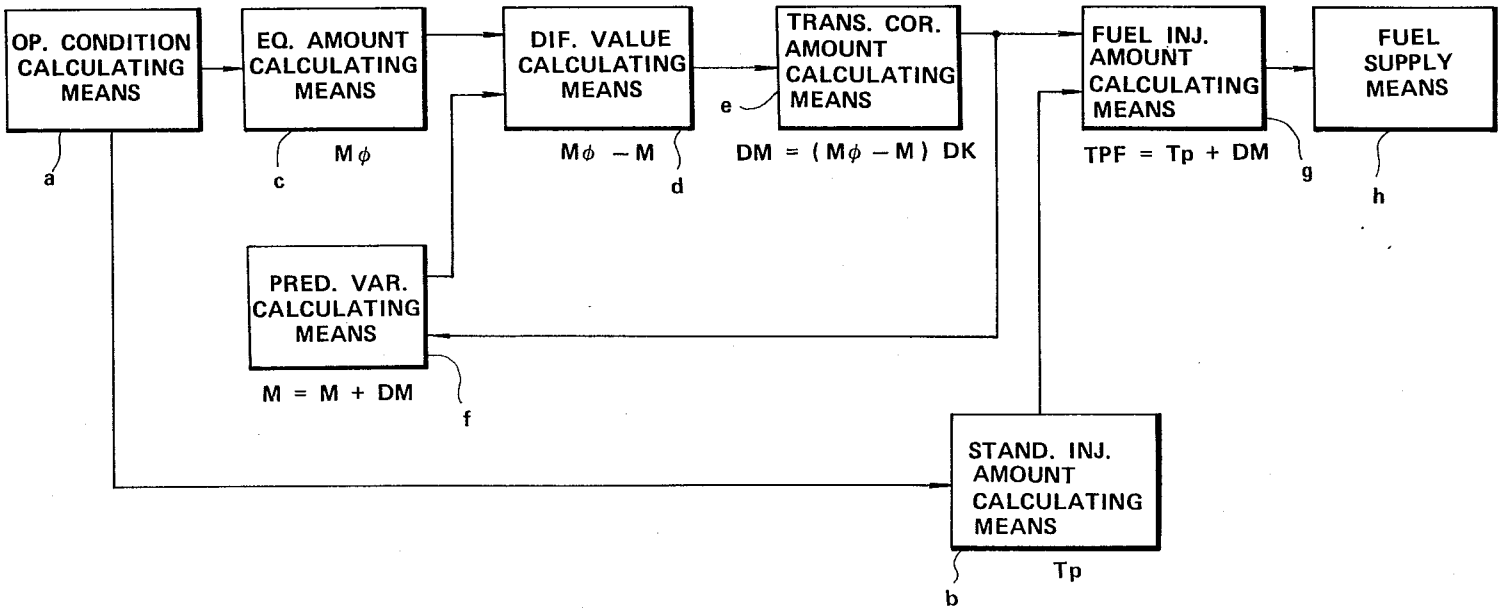
FIG. 1 is a block diagram showing the principle of a first embodiment of a fuel injection control system in accordance with the present invention.

The control unit 29 has function of standart injection amount calculating means b, equilibrium amount calculating means c, difference value calculating means d, transient correction amount calculating means e, and fuel injection amount calculating means g as shown in FIG. 1. The control unit 29 consists of a CPU 30, a ROM 31, a RAM 32 and and an I/O (input and output) port 33. The CPU is arranged to make calculation and processing of data upon taking in outside data from the I/O port 33 in accordance with a program written in the ROM 31 and upon making giving and receiving data between it and the RAM 32, and outputs the thus processed data to the I/O port 33 at need. The ROM 31 stores therein the program for controlling the CPU 30. The RAM 32 is, for example, consists of a non-volatile memory and arranged to store therein data to be used for calculation, in the form of a map or the like, such a stored content being maintained even after stoppage of the engine 21. The I/O port 33 is supplied with signals from the throttle position sensor 25, the air flow sensor 26, the crank angle sensor 27, and the coolant temperature sensor 28, and signals from an air-fuel ratio sensor (not shown) and an ignition switch (not shown). In the I/O port 33, analog signal input thereto is converted to digital signal. Additionally, the I/O port 33 outputs injection signal Si to the fuel injector valve 23.

The manner of operation of the thus arranged fuel injection control system will be discussed hereinafter.

In this embodiment, the air-fuel ratio of air-fuel mixture to be supplied to the engine 21 is controlled by regulating fuel injection amount from the fuel injector upon changing the duty value of the injection signal Si supplied to the fuel injector valve 23, as usual. The duty value of the injection signal Si is calculated by the control unit 29.

Such an operation will be discussed with reference to flowcharts shown in FIGS. 3 and 4 in which the flows are performed in timed relation to, for example, engine speed of the engine 21.

Figure 3:
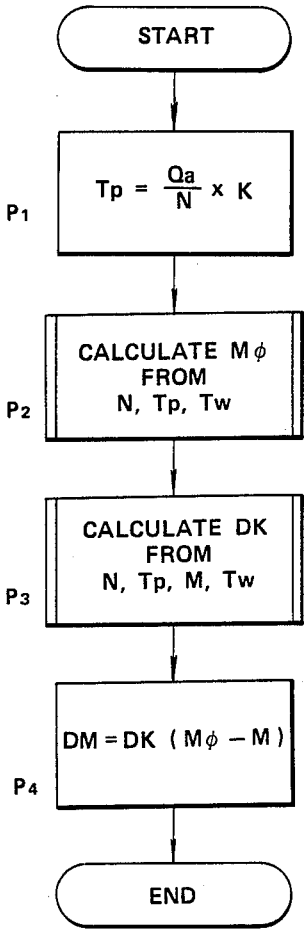
FIGS. 3 and 4 are flowcharts showing a main routine of fuel injection control of the first embodiment fuel injection system.

In the flowchart FIG. 3 showing a standard injection amount calculation routine, a standard injection amount Tp and a transient correction amount DM (discussed after) will be determined.

First at a step $P_1$, the standard injection amount Tp is calculated in accordance with the following equation (1):

$$Tp = \frac{Qa}{N} \times K \quad (1)$$

where K is a constant.

Figure 5:
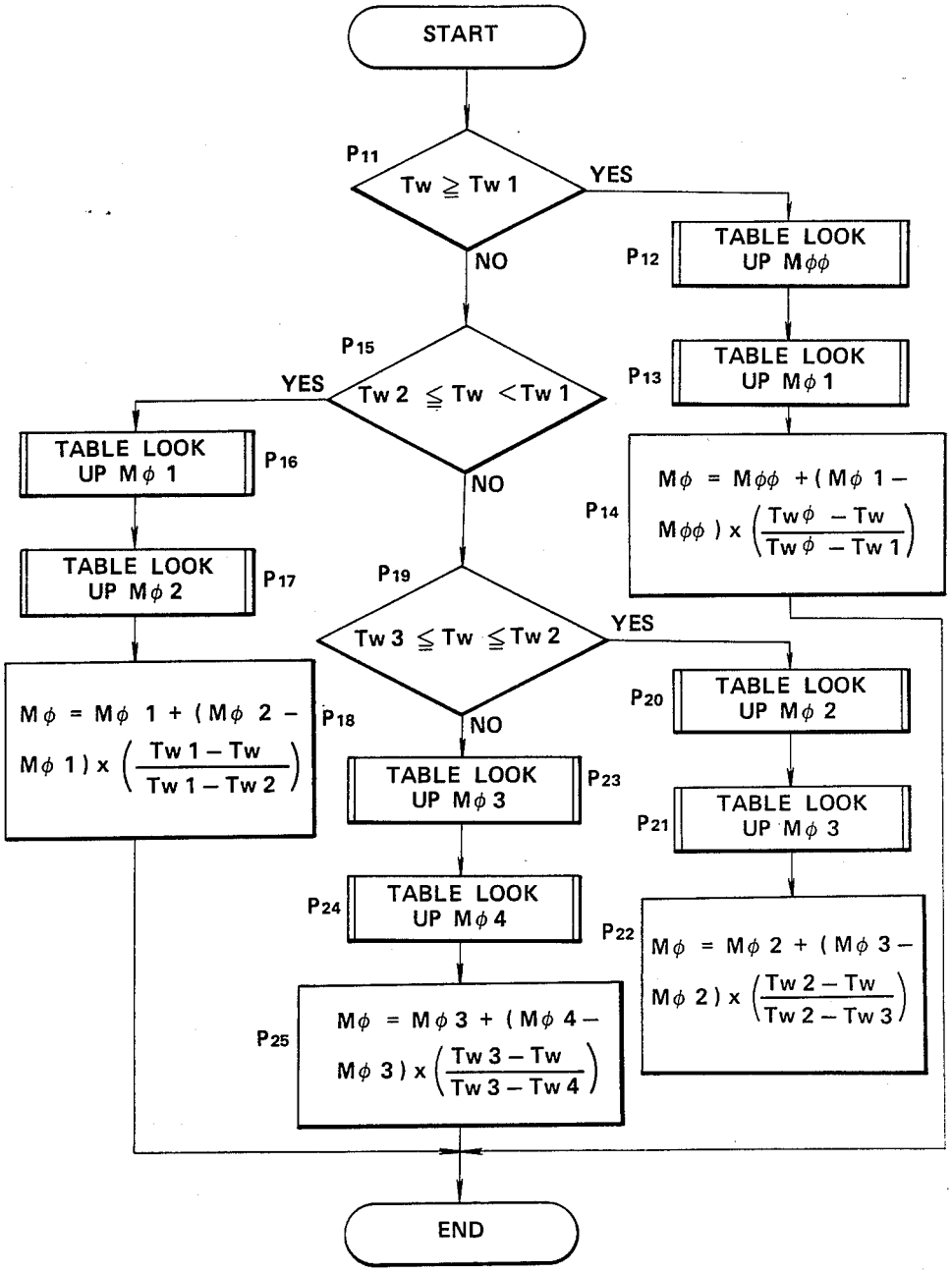
FIG. 5 is a flowchart of a subroutine of the main routine of FIGS. 3 and 4, showing calculation of an equilibrium amount.
Figure 7:
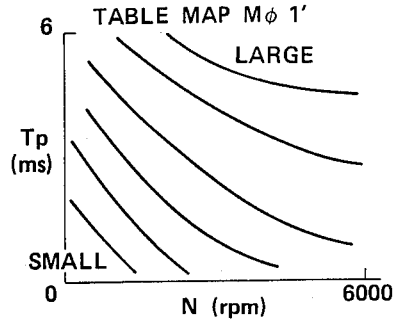
FIG. 7 is a table map showing an example of the equilibrium amount in connection with FIG. 5.
Figure 8:
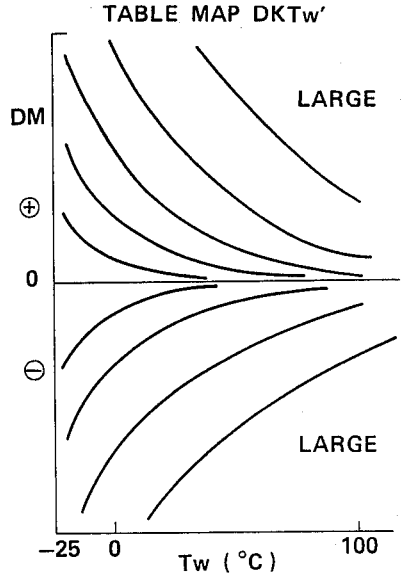
FIG. 8 is a table map of a coolant temperature correction coefficient in connection with FIG. 6.
Figure 9:
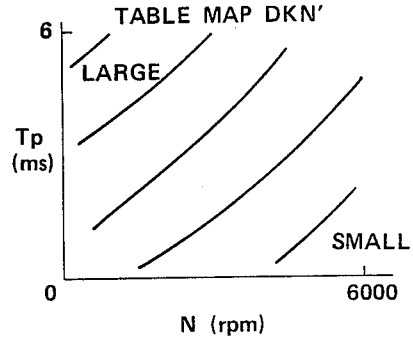
FIG. 9 is a table map of an engine speed correction coefficient in connection with FIG. 6.

Next at a step $P_2$, the equilibrium amount (amount in steady state engine operation) Mϕ of adhering and floating fuel in the intake system (including the intake manifold and intake ports) in a steady state engine operation is calculated in accordance with the engine speed N, the standard injection amount Tp and the coolant temperature Tw. It will be understood that the adhering and floating fuel includes fuel droplet adhering to the inner surface of the intake manifold (intake pipe 22) and the intake port and fuel mist floating inside the intake manifold and the intake port. More specifically, the equilibrium amount Mϕ is determined from a flowchart of FIG. 5 showing an equilibrium amount calculation routine as follows: The equilibrium amount Mϕ0–Mϕ4 are allocated and stored in the RAM 32, in which the equilibrium amount Mϕ is determined by looking up necessary data from the corresponding table maps and making a linear approximate interpolation calculation. The equilibrium amounts Mϕ0–Mϕ4 are respectively obtained as experimental values whose parameters are the engine speed N and the standard injection amount Tp with respect to different coolant temperatures Tw0–Tw4. For example, the equilibrium amount Mϕ is determined as follows: In case where the temperature Tw1 at a step $P_{11}$, an equilibrium amount Mϕϕ according to the engine speed N and the standard injection amount Tp is looked up from a table map (not shown) similar to that Mϕ1′ in FIG. 7, corresponding to the coolant temperature Tw0 at a step $P_{12}$, whereas an equilibrium amount Mϕ1′ according to the engine speed N and the standard injection amount Tp is looked up from a table map Mϕ1′ (as shown in FIG. 7) corresponding to the coolant temperature Tw1 at a step P13. Subsequently, the equilibrium amount Mϕ is calculated from the coolant temperature Tw by the following linear approximate interpolation calculation at a step $P_{14}$:

$$M\phi = M\phi\phi + (M\phi 1 - M\phi\phi)\left(\frac{Tw\phi - Tw}{Tw\phi - Tw1}\right)$$

Similarly, in case of 2≦Tw≦Tw1, $$M\phi = M\phi 1 + (M\phi 2 - M\phi 1) \times \left(\frac{Tw1 - Tw}{Tw1 - Tw2}\right).$$

In case of Tw3≦Tw<Tw2, $$M\phi = M\phi 2 + (M\phi 3 - M\phi 2) \times \left(\frac{Tw2 - Tw}{Tw2 - Tw3}\right).$$

In case of Tw<Tw3, $$M\phi = M\phi 3 + (M\phi 4 - M\phi 3) \times \left(\frac{Tw3 - Tw}{Tw3 - Tw4}\right).$$

Thus, the respective equilibrium amount Mϕ in the various cases are determined.

Figure 6:
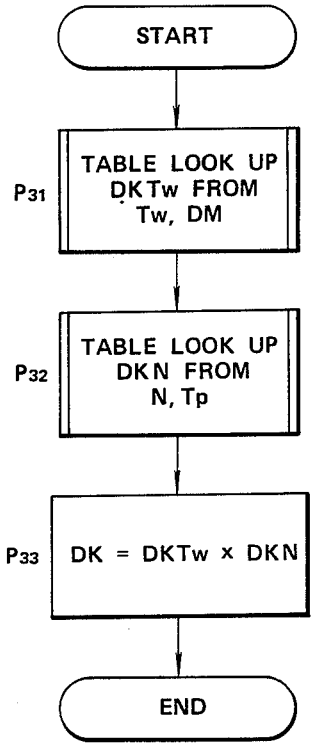
FIG. 6 is a flowchart of another subroutine of the main routine of FIGS. 3 and 4, showing calculation of a correction coefficient.

Next, turning back to the flowchart of FIG. 3, a correction coefficient DK is calculated at a step $P_3$. The correction coefficient DK is a coefficient representing the rate of compensation of the latest fuel injection amount correction relative to shortage or excess amount of the adhering and floating fuel in the intake system. Although this correction coefficient DK may be a constant value, it is determined from experimental values in accordance with the engine speed N, the standard injection amount Tp and the trasient correction amount DM mentioned after. More specifically, the correction coefficient DK is calculated according to a flowchart of FIG. 6 showing a correction coefficient calculation routine. First at a step $P_{31}$, a coolant temperature correction coefficient DKTw is looked up from a table map DKTw′ (shown in FIG. 8) which is obtained as experimental values whose parameters are the coolant temperature Tw and a target correction amount DM. At a step $P_{32}$, an engine speed correction coefficient DKN is looked up from a table map DKN′ (shown in FIG. 9) which is obtained as experimental values whose parameters are the engine speed N and the standard inujection amount Tp. Then at a step $P_{33}$, the correction efficient DK is calculated according to the following equation (2):

$$DK = DKTw \times DKN \quad (2)$$

Next, turning again back to the flowchart of FIG. 3, at a step $P_4$. the routine is terminated after the transient correction amount DM is calculated according to the following equation (3):

$$DM = DK(M\phi - M) \quad (3)$$

Where M is a predicted variable. The predicted variable M represents a predicted value of the adhering and floating fuel in the intake system at a point of time, and therefore is suitably calculated in accordance with engine operating condition. Accordingly, Mϕ- M represents the shortage amount or excess amount of the predicted adhering and floating fuel amount relative to the adhering and floating fuel amount in an equilibrium state.

Figure 4:
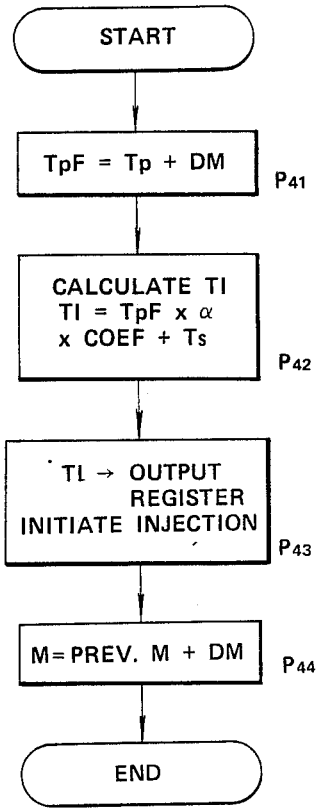

Next, an actual fuel injection amount TI and the above-mentioned variable M will be calculated in a flowchart of FIG. 4 showing a fuel injection amount calculation routine.

First at a step $P_{41}$, a fuel injection amount TpF is calculated according to the following equation (4):

$$TpF = Tp + DM \quad (4)$$

Subsequently at a step $P_{42}$, the actual injection amount T1 is calculated according to the following equation (5):

$$TI = TpF \times \alpha \times COEF + Ts \quad (5)$$

where $\alpha$ is an air-fuel ratio feedback correction coefficient which increases or decreases according to output of an oxygen sensor (not shown) for detecting air-fuel ratio; COEF is a correction coefficient for carrying out a correction for providing an air-fuel ratio for the maximum power output at engine full throttle, an amount increasing correction at engine start, and an amount increasing correction at low engine coolant temperature; and Ts is a voltage correction amount which is conventionally used.

The thus obtained actual fuel injection amount TI is stored as a voltage pulse width having a predetermined duty value in an output register of the I/O port 33 at a step $P_{43}$, and is output as the injection signal Si to the fuel injector valve 23. As a result, a predetermined amount of fuel is injected from the fuel injector valve 23. Subsequently at a step $P_{44}$, the routine is terminated after the above-mentioned variable M is calculated according to the following equation (6):

$$M = \text{previous } M + DM \quad (6)$$

The transient correction amount DM corresponds to a variable amount of the adhering and floating fuel in the intake system during transient time or transient engine operation, and therefore the variable M representing the adhering and floating fuel amount at the present time point has been corrected by the transient correction amount DM, in which the variable M is used in the calculation of the subsequent transient correction amount DM as a subsequently used predicted value M+DM.

While the engine speed N, the standard injection amount Tp, and the coolant temperature Tw have been shown and described as being used to obtain the equilibrium amount M$\phi$ and the correction coefficient DK, it will be understood that, for example, the intake air amount Qa, pressure within intake pipe 22, or the throttle valve position (opening degree) Cv may be used in place of the standard injection amount Tp, whereas temperature within the intake pipe 22 may be used in place of the coolant temperature Tw.

Figures 10A, 10B, 10C:
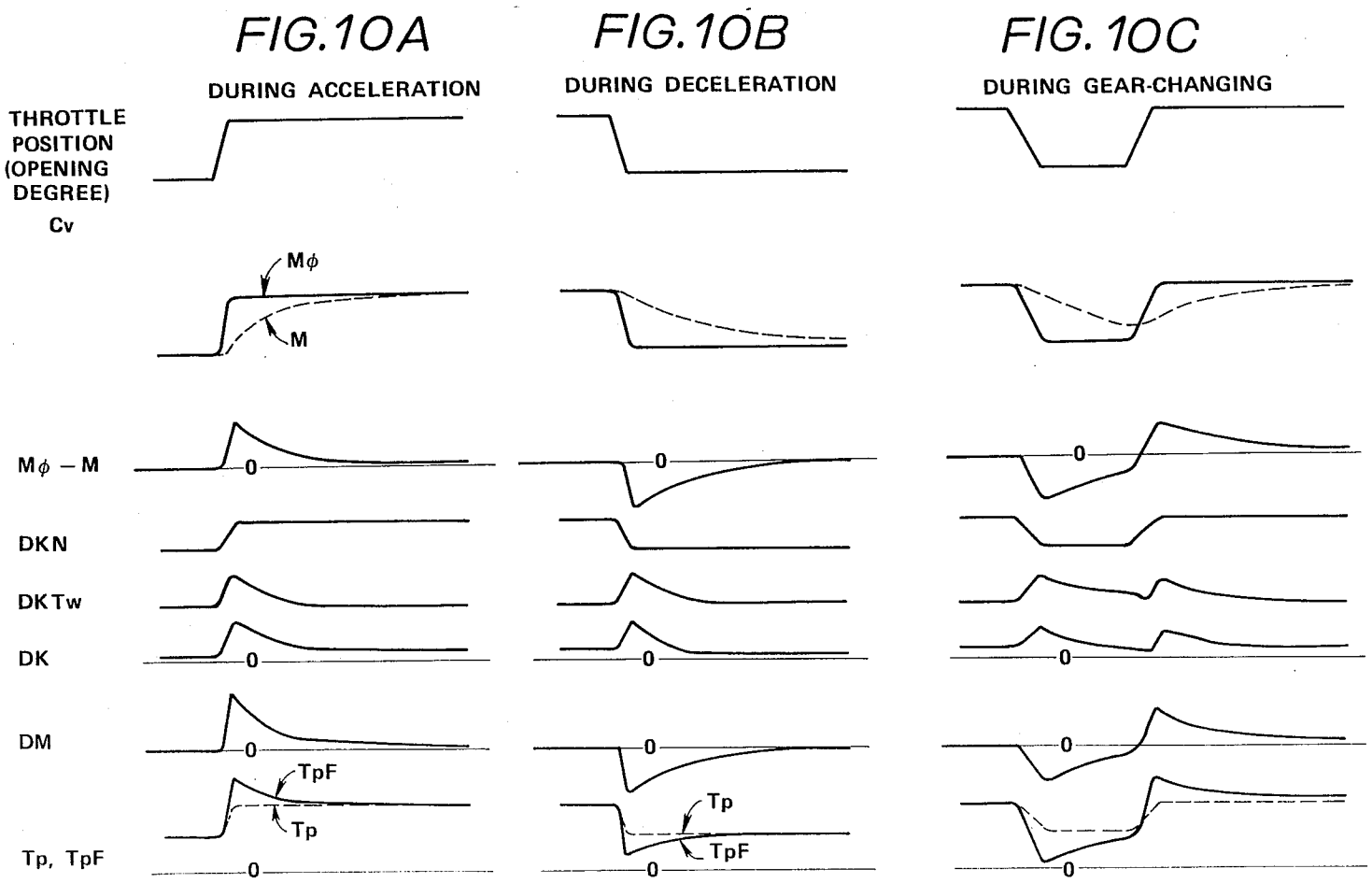
FIGS. 10A to 10C are graphs showing wave forms of a variety of signals during acceleration, deceleration, and gear-changing, respectively, in connection the first embodiment fuel injection control system.

Figs. 10A, 10B and 10C show effects obtained by the above-discussed first embodiment fuel injection control system, in which respective wave forms of M$\phi$, M, M$\phi$-M, DKN, DKTw, DK, DM, Tp and TpF are shown in FIG. 10A (during acceleration), FIG. 10B (during deceleration), and FIG. 10C (during gear-changing). As apparent from these figures, during acceleration and deceleration, highly precised transient correction amount DM in comformity with the degree and condition of the acceleration and deceleration can be obtained. As a result, an optimum fuel injection amount TpF can be obtained thereby providing an optimum air-fuel ratio of air-fuel mixture to be supplied to the engine 21. Furthermore, even during gear-changing, a correction can be precisely and continuously carried out without making a control such as a change-over between acceleration amount increase and deceleration amount decrease thereby achieving driveability improvement, harmful gas emission reduction, engine power output increase, and fuel economy improvement.

Figure 11:
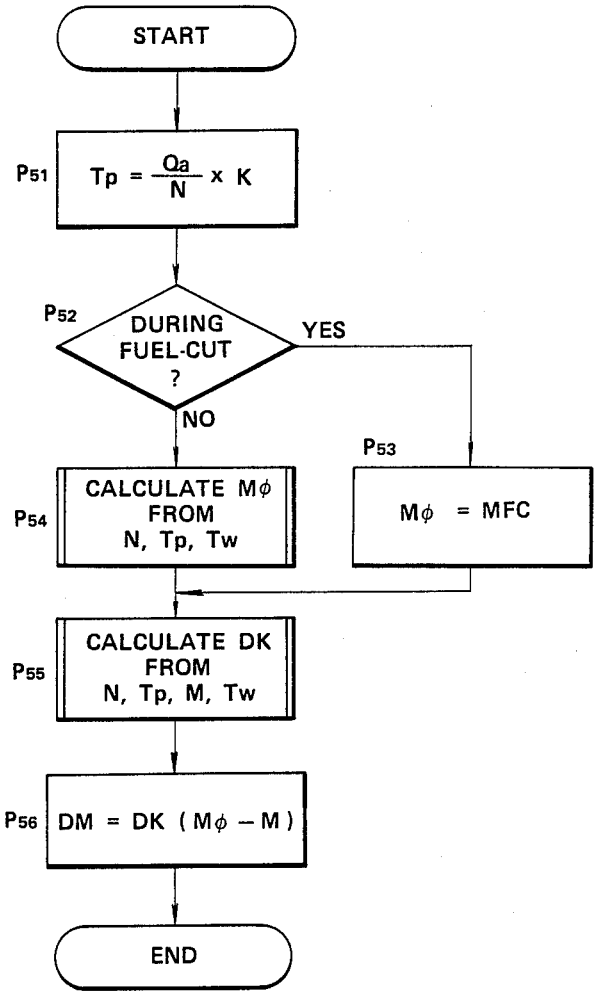
FIG. 11 is a flowchart similar to FIG. 3 but showing a main routine of fuel injection control of a second embodiment of the fuel injection control system in accordance with the present invention.
Figure 12:
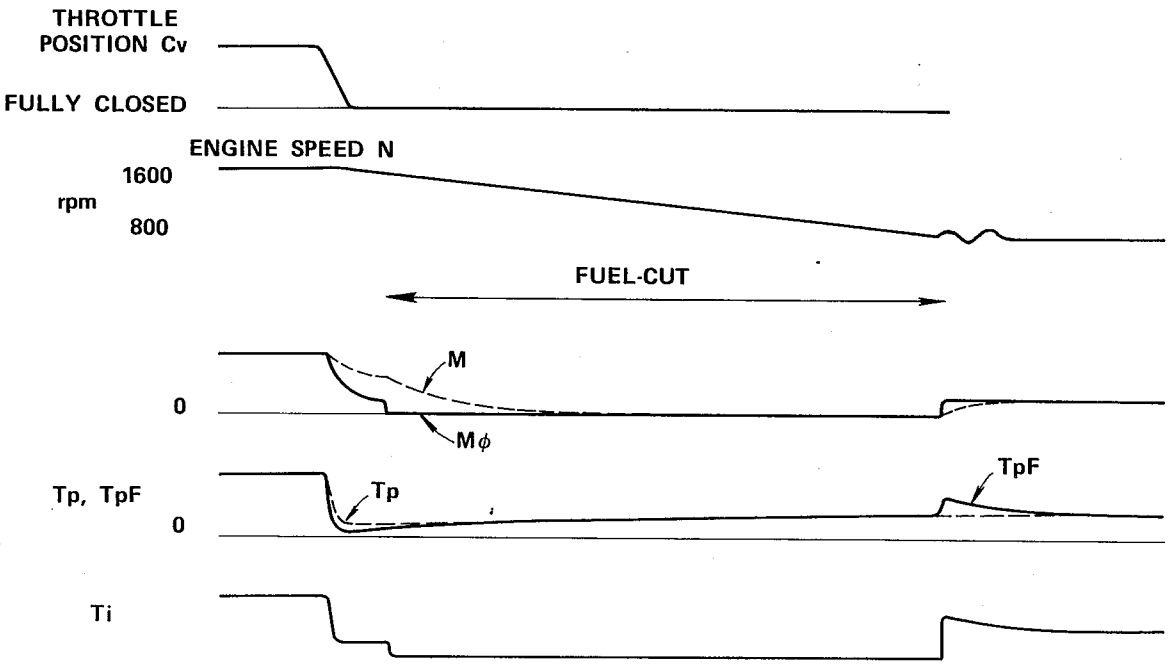
FIG. 12 is a graphs showing wave forms of a variety of signals at a fuel-cut mode in connection with the second embodiment fuel injection control system.

FIGS. 11 and 12 illustrate a second embodiment of the fuel injection control system in accordance with the present invention. In this embodiment, control of the above-mentioned transient correction amount DM is applied to operation during fuel-cut (fuel injection from the fuel injector valve 23 is stopped) and operation during recovery (fuel injection from the fuel injector valve 23 is again initiated after fuel-cut).

FIG. 11 shows a flowchart similar to that of FIG. 3 except for provision of step $P_{52}$ and $P_{53}$. In the flowchart of FIG. 11, after the standard injection amount Tp is calculated at a step $P_{51}$, a decision is made as to whether fuel-cut has been carried out or not at a step $P_{52}$. If the fuel-cut has not been carried out, flow goes to a step $P_{54}$. When the fuel-cut has been carried out (i.e., during fuel-cut), the equilibrium amount M$\phi$ is set a predetermined value MFC which is, for example, zero or a value much smaller than the usual equilibrium amount M$\phi$ at a step $P_{53}$. Then, the correction coefficient DK and the transient correction amount DM are respectively calculated at steps $P_{55}$ and $P_{56}$, so that the routine is terminated. If not during the fuel-cut, the routine is terminated through the steps $P_{54}$–$P_{56}$ similarly to in the above-discussed case.

Here, in general, air-fuel ratio unavoidably shifts to lean side during fuel-cut and during recovery. This is because the adhering and floating fuel in the intake system is sucked into the engine 21 during fuel-cut, and fuel becomes insufficient by an amount again adhering to the intake system only with a fuel injection amount corresponding to the intake air amount Qa during recovery. However, with this embodiment, the quilibrium amount M$\phi$ is set, for example, at zero during fuel-cut as shown in FIG. 11, and therefore the variable M is gradually minimized and gradually approaches to the equilibrium amount M$\phi$. Accordingly, when the equilibrium amount M$\phi$ becomes a predetermined value during recovery, M$\phi$-M$>$0 is established so that a suitable amount increase correction is made. In case where the time of fuel-cut is shorter, i.e., the operation of fuel-cut and recovery is initiated when M$\phi$-M has not yet become a larger value, M$\phi$-M during recovery does not become a so large value and the transient correction amount DM becomes a smaller value. In this case, the adhering and floating fuel amount in the intake system is not so decreased, and therefore an appropriate correction can be carried out upon taking it into consideration.

Similarly, an amount increase control during engine start is carried out, in which when an ignition switch (not shown) is turned ON, the variable M is set at zero in a separately programed initialized routine, thereby suitably carrying out the amount increase correction in accordance with the operating condition during engine starting. Furthermore, a similar suitable control can be achieved after fuel explosion at the engine start. In this case, during cold start in which a part of fuel adhers to cylinder wall and dishcarged out of the cylinder (21*a*) without being burnt, it is preferable to increase by an amount corresponding to such a discharged amount.

Thus, with this embodiment, high precision control can be achieved during fuel-cut, recovery, engine start and the like with the minimum correction, though complicated correction has been necessary for the same purpose in the corresponding conventional techniques.

In other words, according to this embodiment, the amount increase correction during engine start and the amount increase correction after engine start can be simplified while omitting the amount increase correction after idling. Additionally, a separate control for correction after fuel-cut is made unnecessary, and separate corrections are unnecessary during acceleration and deceleration.

Figure 13:
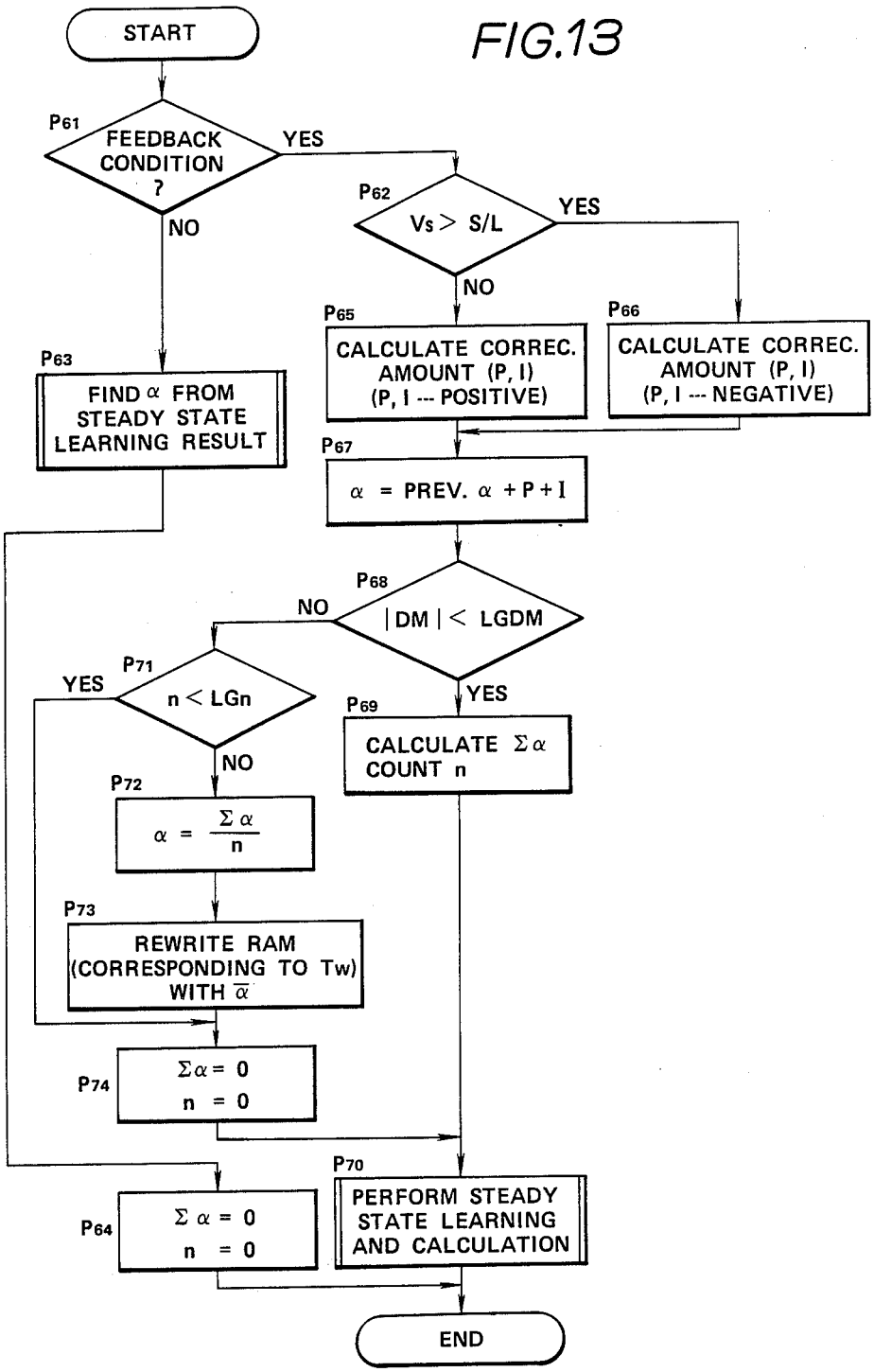
FIG. 13 is a flowchart showing a feedback routine of leaning control of a third embodiment of the fuel injection control system in accordance with the present invention.
Figure 14:
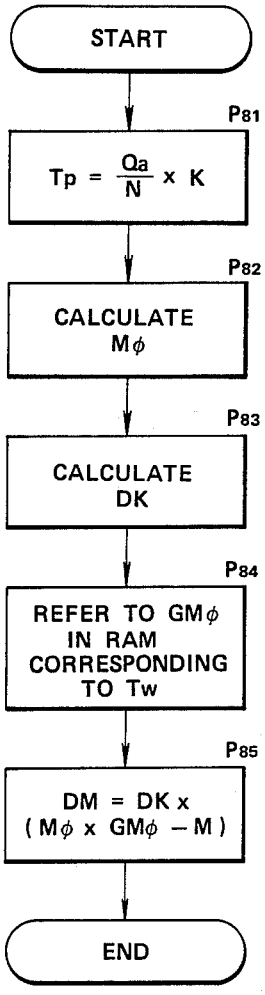
FIG. 14 is a flowchart of a main routine by leaning control of the third embodiment fuel injection control system in connection with the routine of FIG. 13.

FIGS. 13 and 14 illustrate a third embodiment of the fuel injection control system in accordance with the present invention. In this embodiment, learning control is made not only for steady state engine operation but also for engine operation in which transient correction is carried out.

FIG. 13 shows a flow chart of a feedback routine for the learning control. In this flowchart, first at a step $P_{61}$, a decision is made as to whether a feedback condition is established or not. The flow goes to a step $P_{62}$ when established, whereas the flow goes to a step $P_{63}$ when not established. At a step $P_{63}$, a feedback correction coefficient $\alpha$ is obtained upon referring to the address of the RAM 32 in which result of learning in the steady state (engine operation) is stored. At a step $P_{64}$, this routine is terminated upon making both $\Sigma\alpha$ (an accumulated value of $\alpha$) and n (an accumulation number) zero. Subsequently, when the feedback condition is established, the output Vs of the oxygen sensor is compared with a comparative standard value S/L, in which the flow goes to a step $P_{65}$ in case of Vs<S/L in which a decision is made to be leaner than stoichiometric air-fuel ratio, whereas the flow goes to a step $P_{66}$ in case of Vs<S/L in which a decision is made to be richer than the stoichiometric air-fuel ratio. At the step 65, an amount increase amount P is calculated by a PI control. At the step 66, an amount decrease amount I is calculated by the PI control. Subsequently at a step $P_{67}$, a new feedback correction coefficient $\alpha$ is obtained by adding the increase and decrease amounts P+I to the previous feedback correction coefficient, and then the flow goes to a step $P_{68}$. At a step $P_{68}$. the absolute value |DM|, is compared with a comparative standard value LGDM, in which in case of |DM|<LGDM, a decision is made as not being during transient time (during steady state), so that an accumulated value ($\Sigma\alpha=\Sigma\alpha+\alpha$)of $\alpha$ and accumulation number n(n=n+1) of $\alpha$ are obtained at a step $P_{69}$ and then the flow goes to a step $P_{70}$. In case of |DM|>LGDM, a decision is made as being during transient time, so that the accumulation number n is compared with a learning decision frequency LGn. In case of n>LGn, an average value $\bar{\alpha}$($\bar{\alpha}=\Sigma a/n$) is calculated at a step $P_{72}$ and the flow goes to a step $P_{73}$.

At a step $P_{73}$, the address of the RAM 32 corresponding to transient leaning coefficient GMϕ1-GMϕn is rewritten by using the average feedback correction coefficient $\bar{\alpha}$. It will be understood that the transient learning coefficients GMϕ1-GMϕn are respectively allocated to the addresses of the RAM 32, corresponding to the coolant temperatures Tw. Accordingly, at the step $P_{73}$, the content of the address corresponding to the coolant temperature is rewritten. More specifically, it is sufficient that the difference between the average feedback correction coefficient $\bar{\alpha}$ and the value of the RAM 32 corresponding to the coolant temperature Tw is added to the value of the RAM.

When such rewritting is completed, the accumulated value $\Sigma\alpha$ and the accumulation number n are made zero at a step $P_{74}$, the flow goes to the step $P_{70}$. In case of n<LGN at the step $P_{71}$, a decision is made to be low in precision as sample number is too small, in which the accumulated value $\Sigma\alpha$and the accumulation numbre n are made zero, and the flow goes to the step $P_{70}$. Subsequently calculation of learning of steady state (engine operation) is carried out and the this routine is terminated. Although the value of the RAM 3Z is rewritten with the average feedback coefficient $\bar{\alpha}$ like during the transient time upon decision of being in the steady state at the step $P_{70}$ whose content is omitted from explanation, it is preferable that the transient learning coefficients are allocated corresponding to the engine speed N and the standard injection amount Tp in the steady state without corresponding to the coolant temperature Tw.

FIG. 14 shows a flowchart of the routine for calculating the standard injection amount Tp and the transient correction amount DM, similar to that of FIG. 3 with the exception that reference to the transient learning coefficient GMϕ is made at a step $P_{84}$, and the transient correction amount DM is calculated according to the following equation (7):

$$DM=DK\times(M\phi\times GM\phi-M) \quad (7)$$

It is to be noted that reference to the transient learning coefficient GMϕ is accomplished by taking out the value corresponding to the coolant temperature Tw learnt in the above-discussed feedback routine of FIG. 13, from the address of the RAM 32 corresponding to the present coolant temperature Tw. Such transient time learning control is intended to correct the amount of change since the adhering and floating fuel in the intake system changes depending on the character of fuel, or changes with lapse of time depending upon the amount of deposit attached to the inner surface of the intake system. If fuel of an inferior quality is used, air-fuel ratio of air-fuel mixture is shifted to a lean side. In such a case, with this embodiment, the transient learning coefficieng GMϕ is rewritten to be enlarged by using the average feedback correction efficient $\bar{\alpha}$ which has increased during the transient time in the feedback control. Accordingly, the transient correction amount DM is also enlarged, and consequently a correction is made to prevent the air-fuel ratio from becoming leaner during acceleration. Furthermore, the precision of the transient correction amount DM can be gradually raised upon repetition of the learning.

Thus, by virtue of the learning control, the optimum transient correction amount DM can be provided even in case inferior quality fuel is used or in case deposit is attached to the inner surface of the intake system, thereby improving accuracy of air-fuel ratio control of air-fuel mixture to be supplied to the engine.

Figure 15:
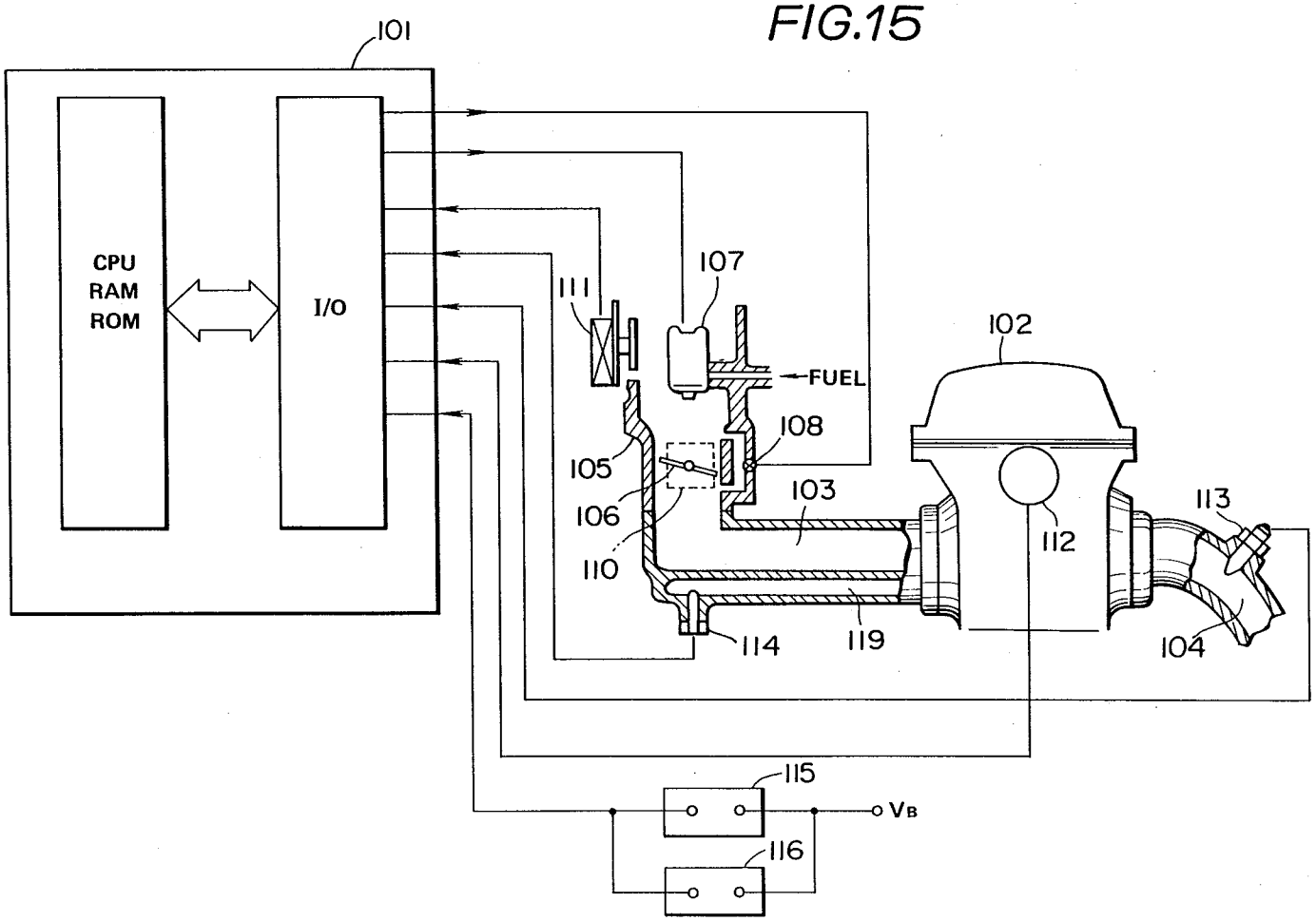
FIG. 15 is a schematic illustration, partly in section, of a fourth embodiment of the fuel injection control system incorporated with an internal combustion engine.

FIGS. 15 to 24 illustrate a fourth embodiment of the fuel injection control system in accordance with the present invention. As shown in Fig. 15, the fuel injection control system of this embodiment is constituted as an electronically controlled fuel injection system and incorporated with a Spark-ignition internal combustion engine 102, in which processing concerning to air-fuel ratio is concentrically performed by a control circuit 101 which is constituted of a microcomputer including a CPU, a RAM. a ROM, and an I/0 (input and output) device and the like.

The engine 102 is as usual provided with an intake system including an intake passage 3 and an intake port (not identified) through which intake air is sucked into the engine 102 together with fuel injected from an electromagnetically operated fuel injector valve 107. The engine 102 is further provided with an exhaust system including an exhaust passage 114 in which an oxygen Sensor 113 is disposed to detect oxygen concentration in exhaust gas. A throttle body 105 is disposed to communicate with the intake passage 103 and provided therein with a throttle valve 106. An idle control valve 108 is provided to control the amount of air required for idling. A warmed water passage 9 is formed adjacent the bottom wall of the intake passage 103 to heat intake air passing through the intake passage 103. The above-mentioned fuel injector valve 107 is supplied from a fuel supply system (not shown) with fuel whose pressure is regulated to be constant, and arranged to inject fuel in amount proportional to valve opening time ratio (duty ratio) of operating signal from the control circuit 101, so that air-fuel ratio of air-fuel mixture to be supplied to the engine 102 is controlled by increase and recrease control of fuel injection amount from the fuel injector valve 107 under control of the control circuit 101.

A throttle position sensor 110 is provided to detect the position or opening degree of the throttle valve 106. An air flow sensor 111 is provided to detect the amount of intake air to be inducted to the engine 102. An engine speed sensor 112 is provided to detect the rotational position and speed of an engine crankshaft (not shown) from rotation of a camshaft. A coolant temperature sensor 115 is provided to detect the temperature of engine coolant or cooling water. A neutral switch 115 is provided to detect the neutral position of a transmission (not shown). Additionally, a clutch switch 116 is provided to detect the engaged state of the a clutch (not shown). It will be understood that the control circuit 101 is arranged to calculate and decide fuel injection amount from the fuel injector valve 107 and accordingly air-fuel ratio of air-fuel mixture to be supplied to the engine 102.

With this arrangement, fuel injection amount control is summarized as follows: A standard (fuel) injection amount Tp to provide a predetermined air-fuel ratio is decided, for example, by making table looking up from the relationship between intake air amount and engine speed detected by the air flow sensor 111 and the engine speed Sensor 112. Then, actual fuel injection amount (the operating signal) TI is calculated by multiplying the standard injection amount Tp by an air-fuel ratio feedback correction coefficient $\alpha$ and another correction coefficient COEF, and further adding to the product an correction amount Ts corresponding to a compensation amount of a non-responsive time of the fuel injector valve 107 correlated to the voltage level of a battery (i.e., $TI = Tp.COEF.\alpha + Ts$). The thus decided operating signal TI is supplied to the fuel injector valve 107. The COEF is a total of correction coefficients given corresponding to engine operating conditions such as engine start, engine warming-up, engine idling and the like.

In this embodiment, a correction corresponding to transient engine operating condition (transient time) is made in the process of deciding the fuel injection amount TI. The content of such a control will be discussed with reference to flowchart of FIGS. 16 to 20 in Which the flowcharts of FIGS. 16 and 17 correspond to a main routine for fuel injection control, whereas the flowcharts of FIGS. 18 to 20 correspond to subroutines for deciding correction valves and the like to be used in the process of performing the main routine.

Figure 16:
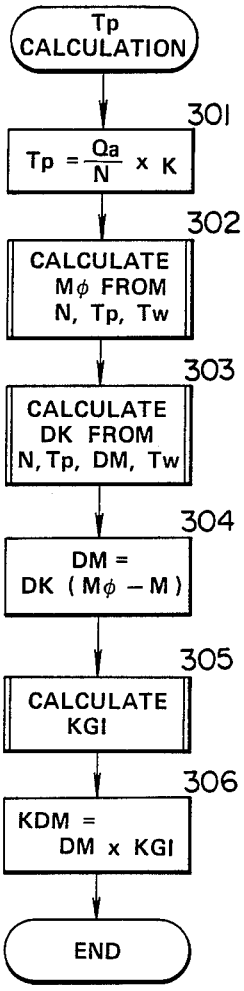
FIGS. 16 and 17 are flowcharts showing a main routine of fuel injection control of the first embodiment fuel injection system.

In this control as shown in FIG. 16, first the standard injection amount Tp is decided at a step 301, which is performed by multiplying the ratio of intake air amount Qa and engine speed N (as parameters) by a predetermined constant K.

Figure 18:
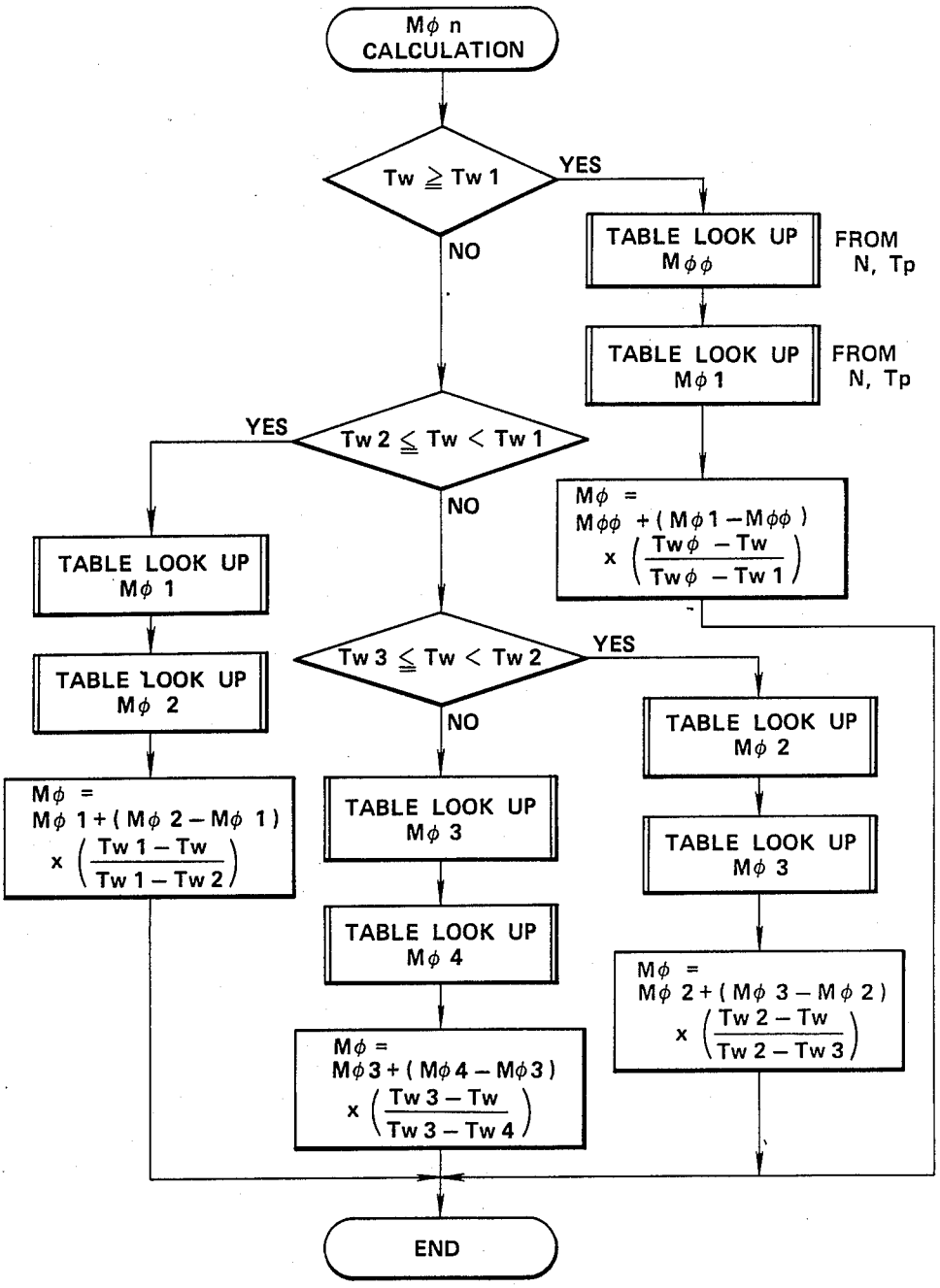
FIG. 18 is a flowchart of a subroutine of the main routine of FIGS. 16 and 17, showing an calculation of an equilibrium amount.
Figure 19:
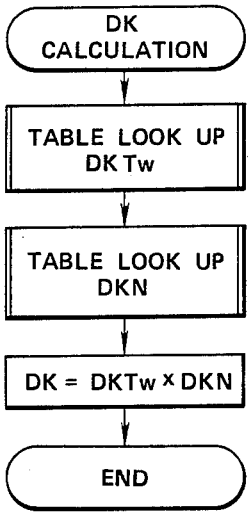
FIG. 19 is a flowchart of another subroutine of the main routine of FIGS. 16 and 17, showing calculation of an approach coefficient.
Figure 21:
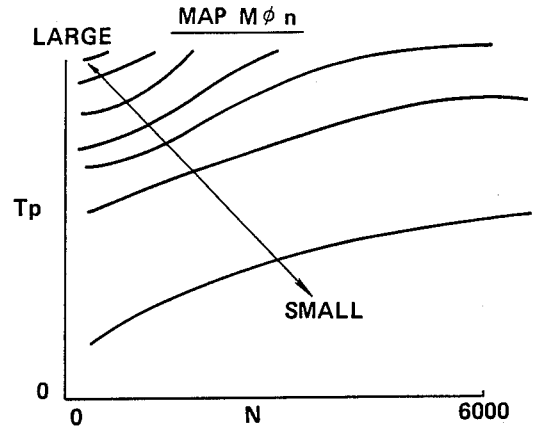
FIG. 21 is a graph of an example of a map providing an equilibrium amount Mϕ of fuel reserved in an intake system in steady state of engine operation in connection with FIG. 18.

Next, an equilibrium (state) amount Mϕ of fuel reserved in the intake system (corresponding to the adhering and floating fuel in the intake system) in steady state engine operation is calculated at a step 302, the equilibrium amount Mϕ serving as the basis of the above-mentioned correction. In this case, the equilibrium amount Mϕ is given from memory tables which are previously prepared for a temperature range Tw0–Tw4 to provide equilibrium amount Mϕϕ–Mϕ4 whose parameters are the standard injection amount Tp and the engine speed N. In other words, the tables for providing, at each of predetermined coolant temperatures, Mϕn of the characteristics examplified in FIG. 21 are stored in the memory of the control circuit 101, in which the equilibrium amount Mϕ is decided by reading out data from the above-mentioned table whose parameters are actual coolant temperature Tw, Tp and N and by making interpolation calculation as shown in the flowchart of FIG. 18. More specifically, five tables for providing respectively Mϕϕ–Mϕ4 are prepared. The Mϕϕ–Mϕ4 whose parameters are Tp and N are respectively for temperatures Tw0–Tw4 (Tw0>Tw4) predetermined within a temperature range actually encountered in the engine coolant, in which each data is read out from the tables corresponding to up-and lower-side standard temperatures serving as the limits of the temperature ranges within which an actual coolant temperature resides, and linear approximate interpolation calculation is carried out using the difference between the actual temperature Tw and the standard temperature thereby to finally decide Mϕ.

Figure 22:
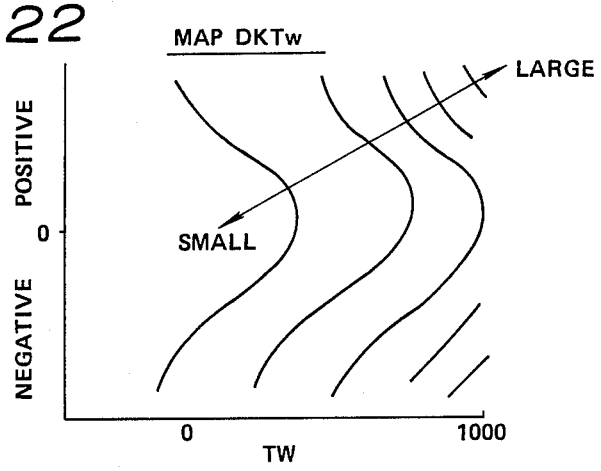
FIGS. 22 and 23 are graphs of examples of maps providing the approach coefficients in connection with FIG. 19.
Figure 23:
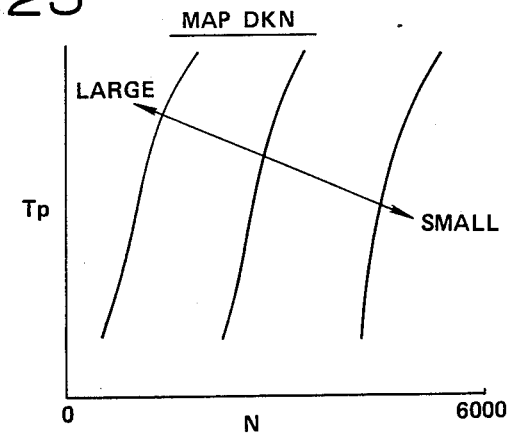

Subsequently, a calculation is made to obtain an (approach) correction coefficient DK representative of a rate at which the predicted variable M of the adhering and floating fuel in the intake system at the present point of time approaches the Mϕ decided above per a unit cycle (for example, every rotation of the engine crankshaft) at a step 303. This is performed as follows: DKTw is given by reading out data from a table previously formed as shown in FIG. 22 in accordance with the coolant temperature Tw and the coefficient DK representative of a fuel shortage amount per a unit cycle and has been decided in the previous processing, and subsequently DKN is given by reading out data from a table formed as shown in FIG. 23 in accordance with N and Tp, in which DKTw and DKN are multiplied by each other to obtain DK as shown the flowchart of FIG. 19.

Furthermore, at a step 304, a fuel shortage amount (corresponding to the transient correction amount) DM by calculation in which the difference between Mϕ and the predicted variable M is multiplied by the coefficient DK. The predicted variable at this time corresponds to that in the previous processing, obtained in the processing shown in FIG. 17. Accordingly, the fuel shortage amount at the present point of time relative to the equilibrium amount of the adhering and floating fuel in the intake system is given by subtracting DM from Mϕ, so that the fuel shortage amount per a unit cycle is decided by multiplying the above-mentioned fuel shortage amount by the (approach) correction coefficient DK. It is to be understood that the shortage amount DM may be negative owing to deceleration condition, in which DM represents fuel excess amount.

Figure 20:
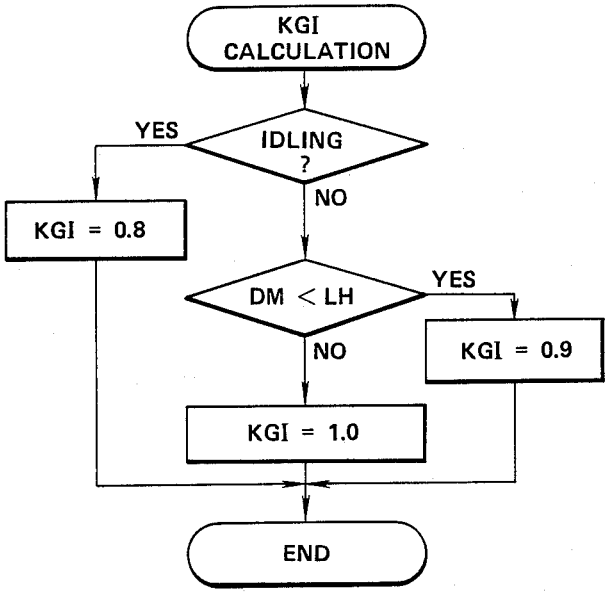
FIG. 20 is a flowchart of a further subroutine of the main routine of FIGS. 16 and 17, showing calculation of a correction rate for a fuel shortage amount.

After the fuel shortage amount DM per a unit cycle is thus decided, a correction rate KGI is calculated in accordance with the engine operating condition at that time. The correction rate KGI is multiplied by the above-mentioned DM thereby to obtain a correction amount KFM for correcting the standard injection amount as shown at steps 305 and 306 of the flowchart of FIG. 16. In this case, KGI is a value variable in accordance with transient engine operation such as an operation from steady state to acceleration state, deceleration state, or idle state. More specifically, as shown in FIG. 20, a decision is made as to whether of being during idling or not according to signal from the throttle position sensor 110 (in FIG. 15) and the like, in which if not during idling, a decision is made as to whether of being during deceleration or other condition such as acceleration and steady state in accordance with comparison between the fuel shortage amount DM and its standard value LH. Here, DM increases during acceleration and decreases during deceleration, so that DM<LH is used as a decision condition. Accordingly, a decision is made to be during deceleration when this decision condition is established and to be during acceleration or in steady state operating condition when the condition is not established, in which KGI is set as 1.0 during acceleration or in steady state operating condition, 0.8 during idling and 0.9 during deceleration. DM is multiplied by the thus decided KGI thereby deciding a final correction amount KDM as shown in the step 306 of the flowchart of FIG. 16.

Figure 17:
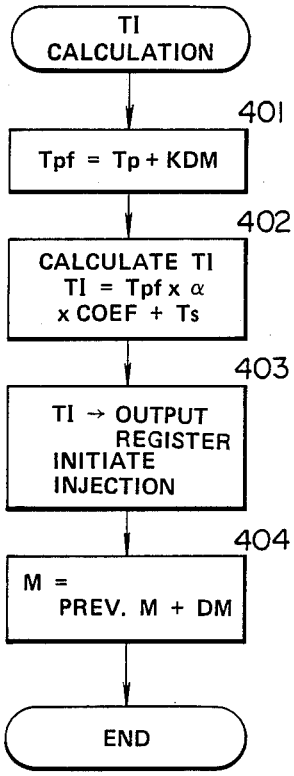

FIG. 17 shows a flowchart of processing of calculation for the final fuel injection amount TI, taking the correction amount KDM into consideration. At a step 401, a new standard injection amount Tpf is calculated by adding the above-mentioned KDM to the standard injection amount Tp. At a step 402, TI is obtained by adding the non-responsive compensation amount Ts to the product of the standard injection amount Tpf, the standard correction coefficient COEF, and the feedback correction coefficient $\alpha$. In the control circuit 101, the thus obtained TI is written in an output register, so that the operating signal corresponding to TI is supplied through the I/O device to the fuel injector valve 117 to accomplish fuel injection in accordance with the operating signal at a step 403. Thereafter, a new predicted variable M is set by adding the present time shortage amount DM to the previous time predicted variable M as shown at a step 404, thus completing a control loop. It will be noted that the processing of FIG. 17 is performed in timed relation to fuel injection timing or crankshaft rotation so that, for example, TI is calculated every rotation of the engine crankshaft in which the predicted variable M is renewed every crankshaft rotation.

Figure 24:
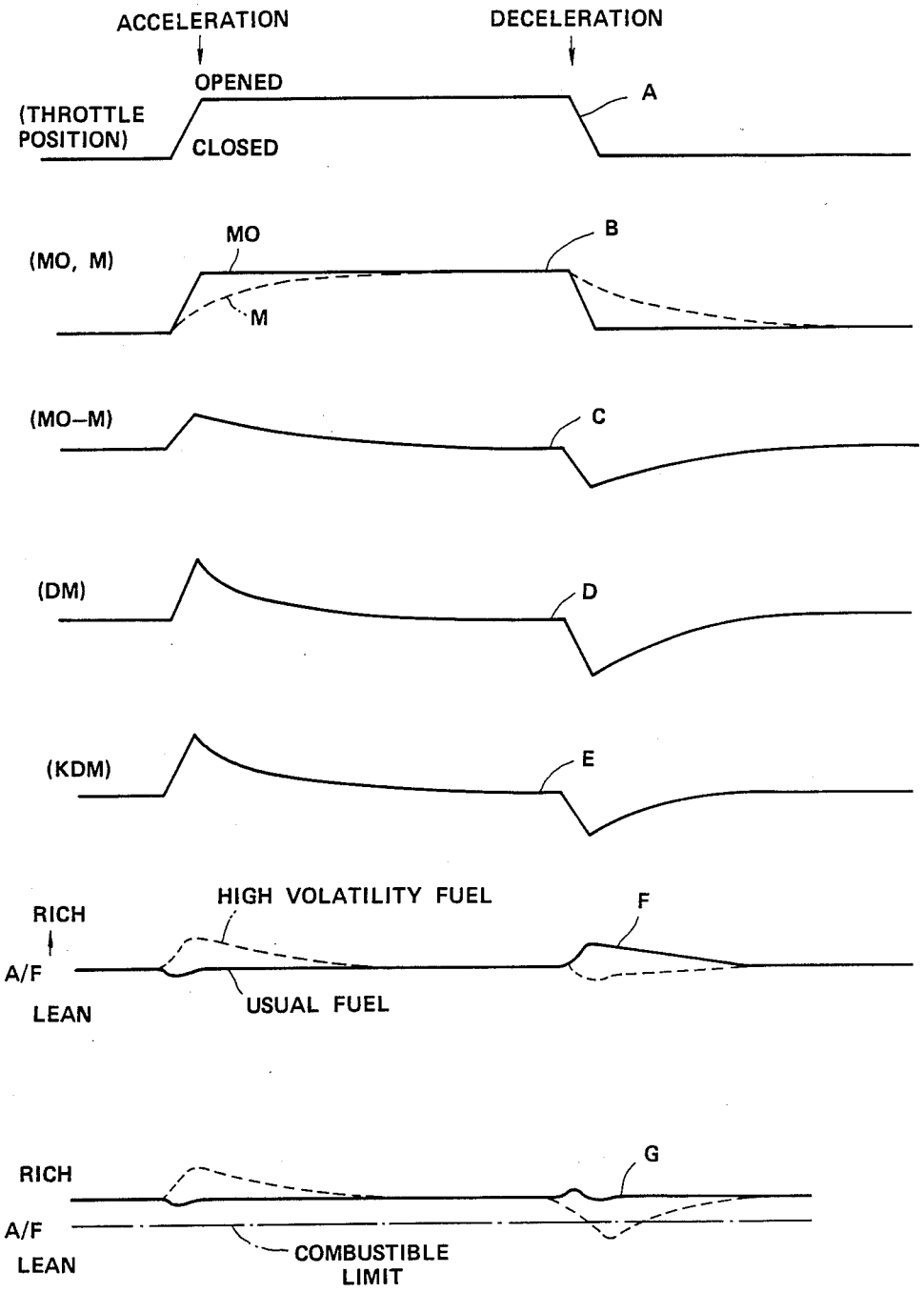
FIG. 24 a graph showing wave forms of a variety of signals during transient engine operation in connection with the fourth embodiment fuel injection control system.

FIG. 24 shows wave forms of a variety of control amounts in the control in FIGS. 16 to 23, i.e., throttle position (opening degree) as indicated by a curve A, the equilibrium (state) amount M$\phi$ and its predicted variable M as indicated by a curve B, difference between M$\phi$ and M as indicated by a curve C, the fuel shortage amount DM per a unit cycle as indicated by a curve D, correction amount KDM as indicated by a curve E, air-fuel ratio (A/F) obtained as a result of control as indicated by a curve F, and air-fuel ratio (A/F) characteristics as indicated by a curve G, in case the correction rate is fixed at 1.0, i.e., correction upon taking account of deceleration and idling was not carried out. As seen from the various wave forms, the fuel amount value DM as a correction amount obtained on the basis of the equilibrium amount M$\phi$ of the reserved fuel in the intake system and its predicted value M changes well corresponding to the actual shortage (or excess) fuel amount. Accordingly, highly precise air-fuel ratio control can be achieved even in transient engine operating condition.

In this case, a correction is made on the correction amount itself in an operating condition from deceleration to idling by multiplying the above-mentioned DM by the correction rate KGI. More specifically, air-fuel ratio correction is made with a correction amount obtained by reducing DM 10–20% in deceleration to idling condition as explained above, in which the amount of fuel to be supplied is corrected to rich side because DM and KDM provides a correction amount to reduce fuel during deceleration. Such correction of the correction amount corresponds to difference in characteristics of fuel to be used, as explained hereinafter. In case where relatively high volality fuel is used, removal of the reserved fuel in the intake fuel becomes active for the sake of the characteristics of the fuel, so that for example the fuel adhering to the inner wall surface of the intake pipe (or the intake manifold) rapidly vaporizes under the effect of development of intake vacuum during deceleration and early suched into engine cylinders. Accordingly, there arises a phenomena of shortage of the reserved fuel in the intake system, so that a part (corresponding to the shortage amount) of fuel injected from the fuel injectors forms new reserved fuel. As a result, the air-fuel ratio becomes leaner by an amount corresponding to the above-mentioned part of fuel throughout an operation time from acceleration terminal period to idling initial period, in which such air-fuel ratio leaning proceeds to such a degree as to temporarily exceed a combustible limit of air-fuel mixture. This causes misfire immediately after deceleration, thereby resulting in engine rotation fluctuation and engine stall. On the other hand, according to the above-mentioned correction of the correction amount in the control of the fourth embodiment fuel injection control system, the correction amount to reduce fuel amount is decreased thereby to make the air-fuel ratio richer. Accordingly, even in case where fuel having a volality higher than that of usual fuel, the most leaner (larger) air-fuel ratio is maintained below the combustible limit and therefore stable engine operation characteristics can be obtained even in a condition where engine operation shifts from deceleration to idling.

Figure 25:
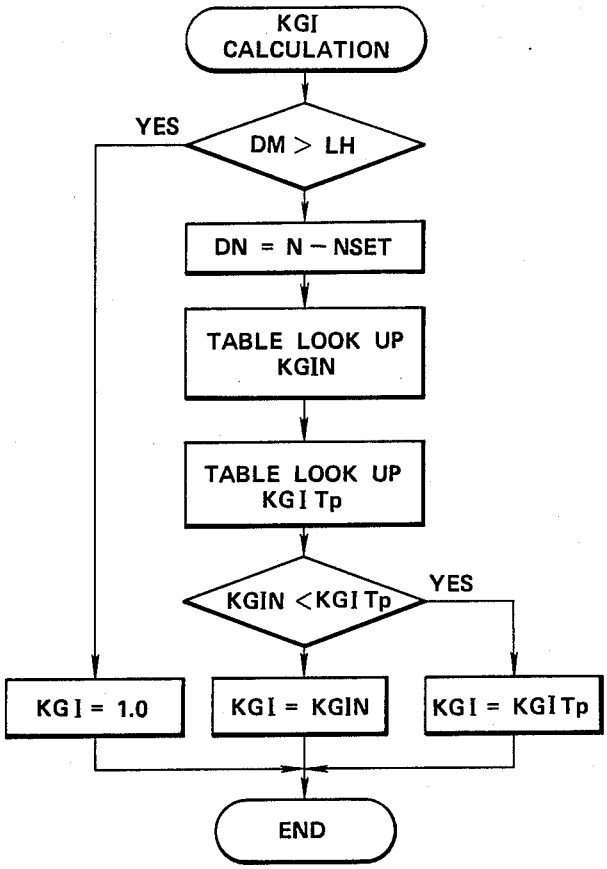
FIG. 25 is a flowchart similar to FIG. 20 but showing the control of a fifth embodiment of the fuel injection control system according to the present invention.

FIG. 25 illustrates a fifth embodiment of the fuel injection control system in accordance with the present invention, similar to the fourth embodiment with the exception that the processing of FIG. 20 is replaced with a processing of FIG. 25 in order to achieve further precise control of the correction amount correction. In this embodiment, the correction rate KGI is finely controllably changed in accordance with a difference DN between actual idle engine speed N and a target value NSET or in accordance with engine load condition represented by the standard fuel injection amount Tp. The process of this control will be discussed with reference to the flowchart of FIG. 25. First a decision is made as to whether of being during deceleration or not upon comparison between the fuel shortage amount DM per a unit cycle and the deceleration decision level LH like in FIG. 20. If not during deceleration, KGI is set at 1.0 so as not to make substantial correction of DM. If during deceleration, the above-mentioned DN is calculated. Then, an engine speed dependence amount KGIN of the correction rate is given by table looking up from the DN, and an engine load dependence amount is given by table looking up from the standard injection amount Tp. Subsequently, a comparison is made between the above-mentioned KGIN and DGITp thereby to decide a larger one of them as KGI. Tables for giving the above-mentioned KGIN and KGITp are, for example, respectively shown in FIGS. 26 and 27, in which KGI is so set as to linearly change within a range from 0.8–1.0 in predetermined DN and Tp regions in the vicinity of idling operating condition.

Figure 26:
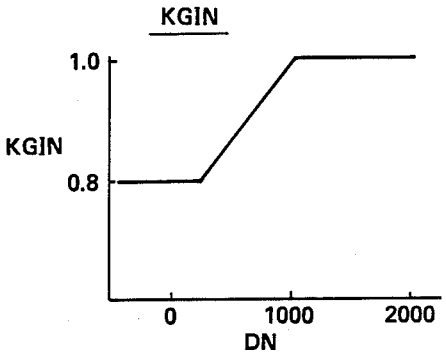
FIGS. 26 and 27 are graphs of examples of tables providing the correction rate in connection with FIG. 25.
Figure 27:
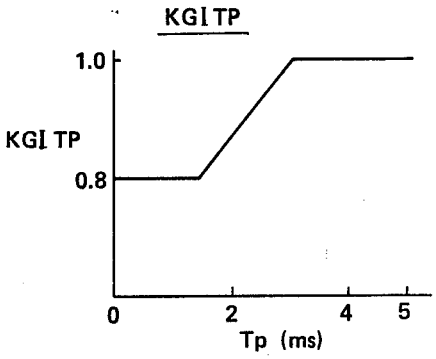

By thus setting the KGI, KGI only in an engine operating condition in the vicinity of idling is minimized, i.e., the correction amount for decreasing fuel injection amount reduces for the first time when engine operation approaches to idling from deceleration; on the contrary, fuel supply amount is suppressed to a necessary minimum value in a process ; of deceleration to the vicinity of idling. As a result, engine stall and unstable engine running are securely prevented in case where high volatility fuel is used, while suppressing fuel supply amount increase in the process of deceleration where relatively low volatility fuel is used, thereby preventing emission of unburnt fuel constituents and improving fuel economy. In this case, since KGI is smoothly changed from deceleration to idling as shown in FIGS. 26 and 27, the correction amount and the air-fuel ratio cannot abruptly change thereby to obtain a smooth driveability.

What is claimed is:

1. A fuel injection control system for an internal combustion engine, comprising:

means for detecting the operating condition of the engine;

means for calculating a standard injection amount in accordance with the engine operating condition;

means for calculating an equilibrium amount of adhering and floating fuel in an intake system of the engine, in a steady state of engine operation, in accordance with the engine operating condition;

means for calculating a difference value between said equilibrium amount of the adhering and floating fuel in the intake system and a predicted variable of amount of the adhering and floating fuel in the intake system at a predetermined point of time;

means for calculating a transient correction amount in accordance with said difference value and a correction coefficient which is previously set in accordance with operating condition of the engine;

means for calculating a fuel injection amount in accordance with said standard injection amount and said transient correction amount and outputting an injection signal representative of said fuel injection amount, said fuel injection amount calculating means including means for calculating said fuel injection amount in timed relation to engine speed; and means for supplying fuel to the engine in accordance with said injection signal.

2. A fuel injection control system as claimed in claim 1, further comprising means for detecting a condition in which fuel-cut is carried out, and means for setting said equilibrium amount of the adhering and floating fuel at a predetermined value smaller than said equilibrium amount and disabling said equilibrium amount calculating means when said condition detecting means detects said fuel-cut condition.

3. A fuel injection control system as claimed in claim 1, further comprising means for allocating a transient learning coefficient corresponding to an engine operating parameter to a RAM, means for referring to said transient learning coefficient allocated in said RAM, corresponding to said engine operating parameter at a predetermined point of time.

4. A fuel injection control system as claimed in claim 3, further comprising means for calculating a transient correction amount in accordance with said equilibrium amount, said predicted value and said transient learning coefficient.

5. A fuel injection control system as claimed in claim 1, further comprising means for calculating a correction rate in accordance with engine operating condition, wherein said fuel injection amount calculating means is arranged to calculate said fuel injection amount in accordance with said standard injection amount, said transient correction amount and said correction rate.

6. A fuel injection control system as claimed in claim 5, further comprising means for controlling air-fuel ratio of air-fuel mixture to be supplied to the engine in accordance with said fuel injection amount.

7. A fuel injection control system as claimed in claim 1, further comprising means for calculating a new predicted value of the adhering and floating fuel in accordance with said transient correction amount and said predicted variable of the adhering and floating fuel, said new predicted value being late in time in control.

8. A fuel injection control system as claimed in claim 1, wherein equilibrium amount calculating means includes means for calculating said equilibrium amount in timed relation to engine speed.

9. A fuel injection control system as claimed in claim 1, wherein said difference value calculating means includes means for calculating said difference value in timed relation to engine speed.

10. A fuel injection control system as claimed in claim 1, wherein said difference value calculating means includes means for calculating said predicted variable in time relation to engine speed.

11. A fuel injection control system as claimed in claim 1, wherein said equilibrium amount calculating means includes means for calculating said equilibrium amount every rotation of engine crankshaft of the engine.

12. A fuel injection control system as claimed in claim 1, wherein said difference value calculating means includes means for calculating said predicted variable every rotation of engine crankshaft of the engine.

13. A fuel injection control system as claimed in claim 7, wherein said new predicted value calculating means includes means for calculating said new predicted value in timed relation to engine speed.

14. A fuel injection control system for an internal combustion engine, comprising:

means for calculating a standard injection amount in accordance with the engine operating condition, said standard injection amount calculating means including means for calculating said standard injection amount in timed relation to engine speed;

means for calculating an equilibrium amount of adhering and floating fuel in an intake system of the engine, in a steady of engine operating, in accordance with the engine operating condition, said equilibrium amount calculating means including means for calculating said equilibrium amount in timed relation to engine speed;

means for calculating a difference value between said equilibrium amount of the adhering and floating fuel in the intake system and a predicted variable of amount of the adhering and floating fuel in the intake system at a predetermined point of time, said difference value calculating means including means for calculating said predicted variable and said difference value in timed relation to engine speed;

means for calculating a transient correction amount in accordance with said difference value and a correction coefficient which is previously set in accordance with operating condition of the engine, said transient correction amount calculating means including means for calculating said transient correction amount in timed relation to engine speed;

means for calculating a fuel injection amount in accordance with said standard injection amount and said transient correction amount and outputting an injection signal representative of said fuel injection amount, said fuel injection amount calculating means including means for calculating said fuel injection amount in timed relation to engine speed; and means for supplying fuel to the engine in accordance with said injection signal.

15. A fuel injection control system as claimed in claim 14, wherein said equilibrium amount calculating means includes means for calculating said equilibrium amount every rotation of engine crankshaft of the engine, and said difference value calculating means includes means for calculating said predicted value every rotation of the engine crankshaft.

* * * * *